United States Patent [19]

Mannino

[11] 4,123,233

[45] Oct. 31, 1978

[54] FUEL MIXTURE CHARGE DEVICE

[76] Inventor: Albert A. Mannino, 300 Chester Ave., Moorestown, N.J. 08057

[21] Appl. No.: 814,698

[22] Filed: Jul. 11, 1977

[51] Int. Cl.[2] ..... F02M 7/24; F02M 13/08

[52] U.S. Cl. ..... 48/180 C; 48/180 M; 48/180 P; 123/52 MF; 123/142; 261/64 C; 261/67; 261/71; 261/DIG. 38

[58] Field of Search ..... 48/180 R, 180 C, 180 P, 48/180 M; 123/120, 52 MF, 142; 261/64 C, 65, 67, DIG. 38, 71

[56] References Cited

U.S. PATENT DOCUMENTS

| | | | |
|---|---|---|---|
| 517,344 | 3/1894 | Lambert | 48/180 M |
| 1,010,051 | 11/1911 | Hoffman | 261/64 C |
| 1,808,537 | 6/1931 | Frazier | 261/65 |
| 3,313,532 | 4/1967 | Carlson et al. | 261/DIG. 38 |
| 3,689,236 | 9/1972 | Mannino et al. | 48/180 P |
| 3,957,929 | 5/1976 | Gural et al. | 261/50 A |

*Primary Examiner*—S. Leon Bashore
*Assistant Examiner*—Peter F. Kratz
*Attorney, Agent, or Firm*—Robert K. Youtie

[57] ABSTRACT

A fuel mixture charge device for communication with the inlet of a combustion chamber including a conduit having inlet and outlet ends, the outlet end being adapted for connection in fluid communication with the combustion chamber and the inlet end communicating with ambient air, a one-way valve in the inlet end of the conduit for passing air only into the conduit, and resilient means operative to urge the valve closed and permit opening under internal pressure reduction for passing air to an engine according to its needs.

4 Claims, 6 Drawing Figures

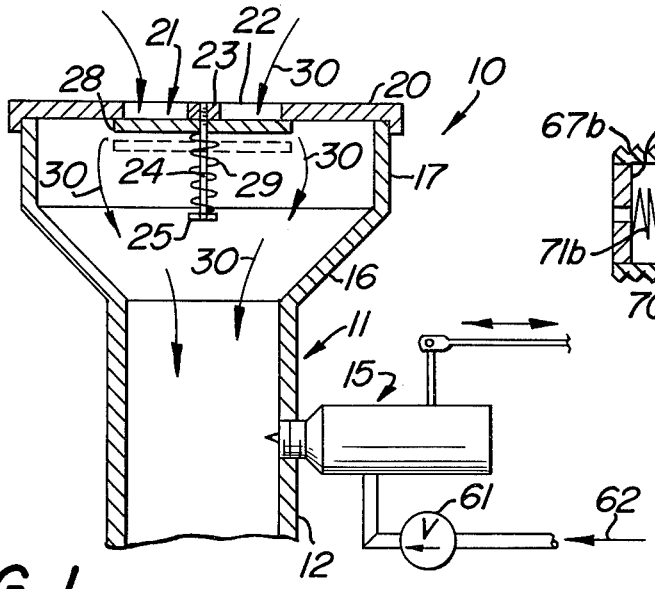
FIG. 1
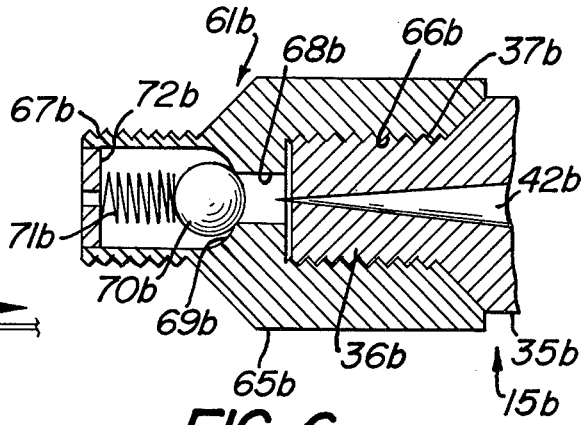
FIG. 6
FIG. 2
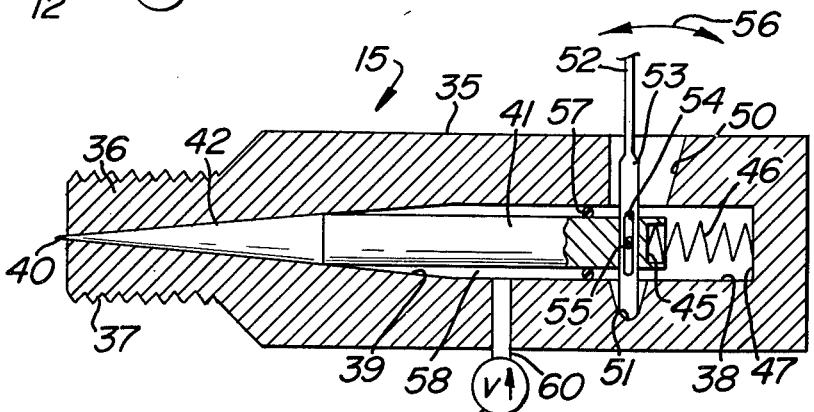
FIG. 3
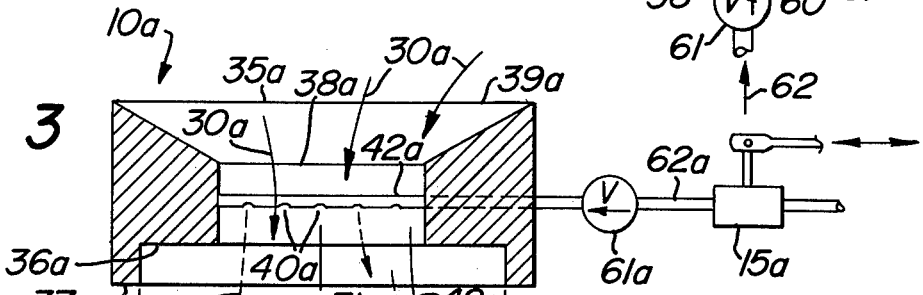
FIG. 4
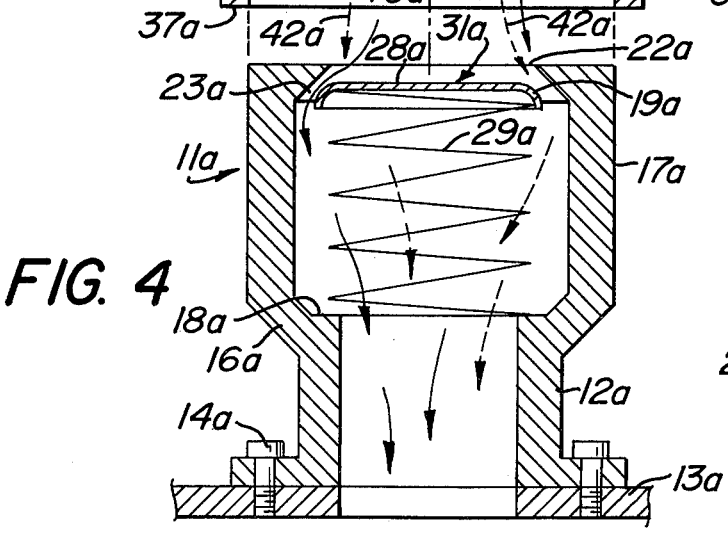
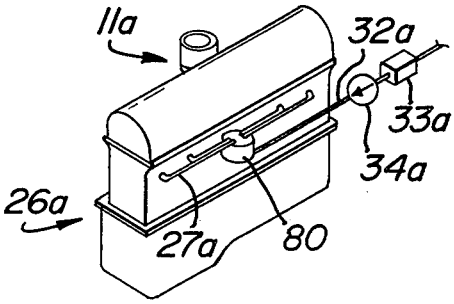
FIG. 5

FUEL MIXTURE CHARGE DEVICE

BACKGROUND OF THE INVENTION

The instant invention is in the same general field as that of my prior U.S. Pat. No. 3,689,236 issued Sept. 5, 1972 and constitutes an improvement thereover. The device of said prior patent employed an air valve having external parts subject to excessive deterioration and damage, and employed a fuel control valve downstream of the air valve. Also, the prior device constituted a carburetor usable with either liquid or gaseous fuel.

SUMMARY OF THE INVENTION

The present invention provides a fuel mixture charge device for an internal combustion engine which includes an automatic air intake valve effectively enclosed to minimize possible wear and damage.

It is another object of the present invention to provide a charge device of the type described which is easily advantageously employed with either liquid or gaseous fuels.

It is still another object of the present invention to provide a charge device for internal combustion engines which may serve either as a carburetor to mix fuel and air, or as an automatically controlled air inlet means for use without a carburetor, as in a fuel injection engine.

Other objects of the present invention will become apparent upon reading the following specification and referring to the accompanying drawings, which form a material part of this disclosure.

The invention accordingly consists in the features of construction, combination of elements, and arrangements of parts, which will be exemplified in the construction hereinafter described and of which the scope will be indicated by the appended claims.

BRIEF DESCRIPTION OF THE DRAWINGS

FIG. 1 is a sectional elevational view showing a fuel mixture charge device or carburetor of the present invention and illustrating an operative position in phantom.

FIG. 2 is an enlarged sectional elevational view showing a fuel control valve of FIG. 1.

FIG. 3 is a sectional elevational view showing a slightly modified embodiment of fuel mixture charge device of the present invention, and showing certain parts exploded to illustrate use as a noncarbureting air intake.

FIG. 4 is a top perspective view showing a fuel injection engine including an automatically controlled air intake conduit as shown in FIG. 3.

FIG. 5 is a top perspective view showing a fuel injection type engine incorporating the charge device of the present invention.

FIG. 6 is a partial sectional view similar to FIG. 2, but showing a slightly modified embodiment.

DESCRIPTION OF THE PREFERRED EMBODIMENTS

Referring now more particularly to the drawings, and specifically to FIGS. 1 and 2 thereof, a fuel mixture charge device or carburetor is shown in FIG. 1 and there generally designated 10. The device includes an air inlet conduit or tubular body 11 having a lower, reduced portion 12 to which is connected a fuel control valve generally designated 15. Extending upwardly from the reduced portion 11 is a flaring portion 16 which terminates in an enlarged upper end portion 17.

An upper end closure or cap 20 is provided across the upper end of the upper end portion 17 and carries, centrally thereof, an inlet valve generally designated 21.

More specifically, the upper end plate or closure cap 20 may be provided with a central through opening or hole 22, say of generally circular outline configuration and formed with a diametral bridging member or support 23. Depending from a medial region of the support 23, into the interior of the conduit 11, is a pin 24 having on its lower or inner end an enlargement or head 25.

A generally circular valve element or plate 28 is slidably circumposed about the pin 24 and of an outline configuration to extend across and completely close the opening 22 when the valve element or plate is in facing engagement with the underside of end plate 20, the solid line position shown in FIG. 1.

Resilient means, such as a coil compression spring 29, may yieldably urge the valve element 28 upwardly to its closed position. More particularly, the resilient compression member or spring 29 may be interposed between and have its opposite ends in bearing engagement with the underside of valve element 28 and upper side of enlargement or head 25. In the illustrated embodiment the coil compression spring 29 is circumposed about the fixed pin 24, and the valve element 28 is yieldably depressible downwardly, say to the dot-and-dash outline position, to open the aperture or hole 22 and pass air in the direction of arrows 30.

The lower end of conduit 11 is connected, by any suitable means, in fluid communication with an inlet manifold of an internal combustion engine, or more specifically in fluid communication with the inlet valve port of an engine combustion cylinder.

The fuel control valve 15 is shown in greater detail in FIG. 2, and as there illustrated includes a generally cylindrical body 35 having at one end a reduced coaxial extension 36 provided with external screwthreads 37. Internally, the cylindrical body 35 is provided with a concentric cylindrical bore 38, which tapers, as at 39, toward and through the reduced extension or nipple 36, and terminates in a reduced end opening 40.

Internally of the bore 38 and its tapering region 39 is a generally cylindrical pin or needle 41, which is of a diameter to be concentrically spaced within the cylindrical bore 39, and terminates in a tapering end section 42 within the tapering bore portion 39. The degree of taper of needle portion 42 may be approximately equal to that of the bore portion 39 for snug closing conforming engagement of the former in the latter.

The larger or outer end of pin or needle 41 may be recessed, as at 45 for receiving a resilient biasing means or coil compression spring 46 interposed between the needle 41 and inner end 47 of the bore 38. Thus, the needle 41 is resiliently urged by spring 46 toward its conforming engagement or closed position, as shown, with the tapering needle portion 42 engaged in the tapering bore portion 39.

The body 35 may be provided with a transverse cutout, hole or notch 50 extending downwardly into the body 35, intersecting with and extending transversely across the bore 38 adjacent to and spaced from the bore end 47, and terminating in a blind end 51 between the bore 38 and lower exterior of the body 35. A control lever or arm 52 may extend into the notch 50. The control lever may have its lower end bifurcated or forked as at 53 astride the needle 41, and provided with slots 54. Pintles 55 project from opposite sides of the needle 41 into respective slots 54, and the control lever or arm 52 is rockable about its lower end at 51, in the directions of arrow 56, to effect longitudinal shifting of the needle 41.

Inward of the cutout 50, a sealing annulus or "O" ring 57 is circumposed about the needle to occlude or close the space between the needle and the internal surface of body 35. Thus, a chamber 58 is defined within the bore 38 and its reduced portion 39, between the body 35, needle 41 (when the latter is in its closed position), and the annular seal 57.

Connected in communication with chamber 58 is a fuel feed conduit 60, passing through the wall of body 35 and extending therefrom to a source of fuel supply, say a tank of liquid or gaseous fuel. Connected in the fuel supply conduit 60 is a one-way or check valve 61 which passes fuel only in a single direction, namely the direction of arrow 62.

In operation, with the lower end of conduit tube 12 connected in fluid communication with the inlet manifold of an internal combustion engine, engine speed is selected by positioning the lever 52 at a selected location of its rocking movement so that the fuel supply conduit 60 communicates through chamber 58 and a constricted space between needle 41 and the interior of convergent bore portion 39, through discharge opening 40 into the tube 12. In the tube 12 air is entering from the environs at a proper rate for engine operation to mix with the fuel for passage to the combustion cylinders. The rate of air flow varies with engine speed, as by greater or lesser opening of one-way air valve 21. The proper air flow is assured by proper selection or adjustment of resilient means 29 and the size of opening 22.

In the use of pressurized liquid or gaseous fuel, or of unpressurized liquid fuel, it will be appreciated that the fuel can only travel in one direction, as that of arrow 62 into chamber 58, and then exiting through opening 40. Escape of fuel through the control arm cutout 50 is prevented by seal 57. Reverse flow of fuel is prevented by check valve 61 in the fuel supply line. Hence, even in the circumstance that fuel is not under pressure in chamber 58, but intended to be aspirated therefrom into conduit 11, a malfunction tending to reverse fuel flow would be precluded by valve 61.

In FIGS. 3 and 4 are shown a slightly modified form of fuel mixture charge device generally designated 10*a*, including an air inlet conduit 11*a* for connection in fluid communication with an inlet manifold 13*a* of an internal combustion engine. The air inlet conduit 11*a* includes a lower tubular portion 12*a* having its lower end suitably connected as by fasteners 14*a* to the engine inlet manifold 13*a*, for fluid communication with the interior of the latter.

From the upper end of the lower conduit portion 12*a*, there extends an upwardly flaring intermediate conduit portion 16*a*, and from the upper end of the latter an enlarged upper conduit region 17*a*. Interiorly of the conduit 11*a*, within the upwardly flaring intermediate portion 16*a*, there is defined an annular internal upward facing shoulder 18*a*.

Within the upper region of the enlarged upper section 17*a* of conduit 11*a* there is provided a one-way valve, generally designated 31*a*. Such valve 31*a* may include a generally flat valve element or plate 28*a*, which may have its peripheral region 19*a* of arcuate configuration, generally convex upwardly and outwardly. Bounding the upper end opening 22*a* of conduit 11*a*, on the inner or lower side thereof, is an obliquely downwardly and inwardly facing, generally conical internal surface 23*a*. The internal conical surface 23*a* may be generally directly over the shoulder 18*a*, and the valve element or plate 28*a* may be of a diameter so as to move into closing relation with respect to opening 22*a*, with the arcuate plate margin 19*a* in closing engagement with the internal conical surface 23*a*. Thus, the plate 28*a* defines a valve element movable into and out of closing relation with respect to the opening 22*a*, and the surface 23*a* defines a valve seat for the valve element.

The valve element 28*a* is resiliently urged toward its closing relation with respect to the opening 22*a* by suitable resilient means, such as a coil compression spring 29*a* interposed between and having its opposite ends in bearing engagement with the shoulder 18*a* and the under or inner side of valve element 28*a*, within the depending peripheral portion or circumferential flange.

As thus far described, the air inlet conduit 11*a* may be associated with an internal combustion engine, such as an engine 26*a* of FIG. 5. The engine 26*a* of FIG. 5 may be of the fuel injection type wherein, fuel is injected directly into the engine combustion chambers, for mixture therein with combustion supporting air from the air inlet conduit 11*a*. For example, the engine 26*a* of FIG. 5 may include a fuel manifold 27*a* connecting the several combustion cylinders to a fuel reservoir 80, which is in turn connected to a fuel supply line 32*a*. The supply line may include a fuel pump 33*a*, and a check valve 34*a*.

By this combination, the required air for engine operation is automatically fed to the combustion chambers. That is, the valve element 28*a* opens more or less according to engine speed as determined by the constant of spring 29*a*. If desired, adjustment means (not shown) may be incorporated say to selectively vary the force of spring 29*a*, or the parameters may be preselected in manufacture for a known subsequent condition of use.

The air inlet conduit 11*a* of FIG. 3 may also be employed in a carburetion type engine. For this purpose, the fuel mixture charge 10*a* may include a generally annular inlet fitting or funnel 35*a* having a central through opening 38*a* which flares upwardly and outwardly, as at 39*a*. The under side of inlet fitting 35*a* is provided with an annular, downwardly facing shoulder 36*a* for seating on the upper end of enlarged conduit portion 17*a*, and a depending circumferential skirt 37*a* surrounds the downwardly facing shoulder 36*a* for engagement about the upper conduit section 17*a*. Any suitable means may be employed to secure the upper end fitting 17*a* on the upper end of conduit 11*a*.

Thus, it will be apparent that air passing through the conduit 11*a*, as by solid line arrows 30*a*, pass initially through the central opening 38*a* of inlet fitting 35*a*.

A fuel feed conduit or line 62*a* is connected at one end to a source of fuel, and has its other end extending into and across the central opening 38*a* of inlet fitting 35*a*, as at 42*a*. The fuel line portion 42*a* may extend diametrically across the opening 38*a* and may be provided on its under side with a plurality of outlet or discharge openings 40*a*, for passing fuel, as in the direction of arrows 42*a*.

Exteriorly of the charge device 10*a*, the fuel supply line may have incorporated therein a fuel flow control valve 15*a*, and a one-way check valve 61*a*, for the same purposes as in the first described embodiment of FIGS. 1 and 2.

Thus, the embodiment of FIG. 3, with the inlet fitting 35*a* assembled to the conduit 11*a*, may serve as a carburetor or fuel mixture charge device which is extremely simple in operation, highly efficient in performance and, relatively free from malfunction and maintenance.

Referring now to the modified embodiment of FIG. 6, there is shown therein a fuel control valve 15*b* which may be essentially the same as valve 15 of the first described embodiment, having a generally cylindrical body 35*b* reduced at one end to provide a coaxial extension 36*b* having external screwthreads 37*b*. The cylindrical body 35*b* includes a bore corresponding to bore 38 of the first described embodiment and receives therein a valve element, pin or needle 42*b* actuable to vary the valve passage opening.

In addition, the embodiment of FIG. 6 includes a one-way or check valve 61*b* having a generally cylindrical body 65*b* provided at one end with internal screwthreads 66*b* and at its other end with external screwthreads 67*b*. The internal screwthreads are threadedly engageable with external screwthreads 37*b* of valve body 35*b*. Internally of one-way valve body 65*b* is a through port 68*b* communicating with the bore of valve body 35*b* and having on its side downstream from the valve 15*b* a seat 69*b*. A valve element or closure 70*b* may be resiliently urged in closing engagement with seat 69*b*, as by resilient means or spring 71*b*. That is, the one-way valve body 65*b* is provided downstream of valve element or ball 70*b* with an upstream facing shoulder 72*b*, and the spring 71*b* is in bearing engagement with and between the shoulder and valve element or closure 70*b* to urge the latter closed against seat 69*b*.

Thus, it will be apparent that the valve 61*b* is operative to open in response to upstream pressure of fluid from 15*b*, and closes to prevent fluid movement in the opposite direction. The external screwthreads 67*b* of one-way valve of 61*b* may be threadedly engageable with the air tube 12 in the same manner as threads 37 of the first described embodiment, so that the one-way valve 61*b* is interposed in fluid communication between the valve 15*b* and conduit 11.

The one-way valve 61*b* may be used as a replacement for or in addition to the one-way valves 61 and 61*a*.

Although the present invention has been described in some detail by way of illustration and example for purposes of clarity of understanding, it is understood that certain changes and modifications may be made within the spirit of the invention.

What is claimed is:

1. A fuel mixture charge device for association with the combustion chamber inlet of an internal combustion engine, said device comprising a longitudinally extending air inlet conduit having inlet and outlet ends, outlet end connection means on said conduit for connection to the combustion chamber inlet in fluid communication therewith, the inlet end of said conduit being connected with the ambient air for conducting air through said conduit to the combustion chamber, a one-way valve in said inlet end of said conduit for passing ambient air into said conduit, resilient means associated with said one-way inlet valve urging the latter closed to permit opening upon reduced pressure in said conduit, for passing air according to engine requirements and a fuel feeding needle valve associated with said conduit for feeding fuel to said conduit and comprising a hollow needle valve body having an inlet connected to a fuel supply pipe and an internally tapering outlet, and elongate needle valve element spaced within the interior of said valve body and longitudinally shiftable therein, an externally tapering end on and movable with said valve element within said internally tapering outlet toward and away from conforming closing engagement therein, a needle valve spring urging said needle valve element toward said closing engagement, and variable manual operating means connected to said needle valve element for selective positioning thereof, and a funnel on the air inlet end of said conduit for directing air into the latter, said fuel feeding needle valve being connected to said funnel for dispensing fuel into the air entering said conduit, said one-way valve comprising a seat in said conduit adjacent to and facing inwardly from its inlet end, and a valve element movable into and out of closing engagement with said seat, and said resilient means comprising bearing means in said conduit inwardly of and facing toward said seat, and resilient compression means interposed between said bearing means and valve element to yieldably urge the latter toward said closing engagement, said bearing means comprising a circumferential internal shoulder in said conduit facing toward said valve element, and said resilient compression means comprising a coil compression spring interposed between said shoulder and valve element, said spring being seated on said shoulder for passage of the air and fuel mixture radially through said spring.

2. A fuel mixture charge device according to claim 1, in combination with a check valve connected in series fluid communication with said needle valve for passing fuel only in the direction toward said conduit under the control of said needle valve.

3. A fuel mixture charge device according to claim 2, said check valve being interposed between said needle valve and conduit.

4. A fuel mixture charge device according to claim 2, said check valve being upstream of said needle valve.

* * * * *